US011615762B1

(12) United States Patent
Minaki et al.

(10) Patent No.: US 11,615,762 B1
(45) Date of Patent: Mar. 28, 2023

(54) EDGE ILLUMINATION ARCHITECTURE FOR DISPLAY DEVICE

(71) Applicant: Synaptics Incorporated, San Jose, CA (US)

(72) Inventors: Tomoo Minaki, Tokyo (JP); Takashi Nose, Kanagawa (JP); Hirobumi Furihata, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/505,577

(22) Filed: Oct. 19, 2021

(51) Int. Cl.
*G09G 5/02* (2006.01)
*G09G 5/10* (2006.01)

(52) U.S. Cl.
CPC ..... *G09G 5/026* (2013.01); *G09G 5/10* (2013.01); *G09G 2310/0232* (2013.01); *G09G 2320/0666* (2013.01); *G09G 2340/04* (2013.01)

(58) Field of Classification Search
CPC ..... G09G 5/026
See application file for complete search history.

(56) References Cited

U.S. PATENT DOCUMENTS

2018/0242242 A1* 8/2018 Lee ..... H04W 68/00

* cited by examiner

*Primary Examiner* — Gustavo Polo
(74) *Attorney, Agent, or Firm* — Ferguson Braswell Fraser Kubasta PC

(57) ABSTRACT

A display driver includes first interface circuitry, a graphic memory, image processing circuitry, and drive circuitry. The first interface circuitry is configured to receive an edge illumination command from a controller external to the display driver. The graphic memory is configured to store image data. The image processing circuitry is configured to render an edge-illuminated image by overlaying an edge illumination graphic on a first image corresponding to the image data in response to the edge illumination command. The edge illumination graphic extends along an edge of a display region of a display panel. The drive circuitry is configured to drive the display panel based on the edge-illuminated image.

17 Claims, 14 Drawing Sheets

Normal Operation Mode

EDGE ILLUMINATION ARCHITECTURE FOR DISPLAY DEVICE

FIELD

The disclosed technology generally relates to devices and methods for edge illumination for display devices.

BACKGROUND

Portable electronic devices (e.g., smartphones, cell phones, and other similar electronic devices) may be adapted to edge illumination (or edge lighting) that notifies the user of calls or other notifications by lighting up the edge of the display. For example, a portable electronic device may be configured to notify the user of reception of emails or other messages with the edge illumination feature. The edge illumination may help the user promptly become aware of notifications especially during standby of the portable electronic device.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display driver is provided. The display driver includes first interface circuitry, a graphic memory, image processing circuitry, and drive circuitry. The first interface circuitry is configured to receive an edge illumination command from a controller external to the display driver. The graphic memory is configured to store image data. The image processing circuitry is configured to render an edge-illuminated image by overlaying an edge illumination graphic on a first image corresponding to the image data in response to the edge illumination command. The edge illumination graphic extends along an edge of a display region of a display panel. The drive circuitry is configured to drive the display panel based on the edge-illuminated image.

In one or more embodiments, a display system is provided. The display system includes a controller, a display panel, and a display driver. The controller is configured to generate an edge illumination command. The display panel includes a display region. The display driver includes first interface circuitry, a graphic memory, image processing circuitry, and drive circuitry. The first interface circuitry is configured to receive the edge illumination command from the controller. The graphic memory is configured to store image data. The image processing circuitry is configured to render an edge-illuminated image by overlaying an edge illumination graphic on a first image corresponding to the image data in response to the edge illumination command. The edge illumination graphic extends along an edge of the display region of the display panel. The drive circuitry is configured to drive the display panel based on the edge-illuminated image.

In one or more embodiments, a method for operating a display driver is provided. The method includes receiving an edge illumination command from a controller external to the display driver. The method further includes storing image data in a graphic memory of the display driver. The method further includes rendering an edge-illuminated image by overlaying an edge illumination graphic on a first image corresponding to the image data in response to the edge illumination command. The edge illumination graphic extends along an edge of a display region of a display panel. The method further includes driving the display panel based on the edge-illuminated image.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1A:
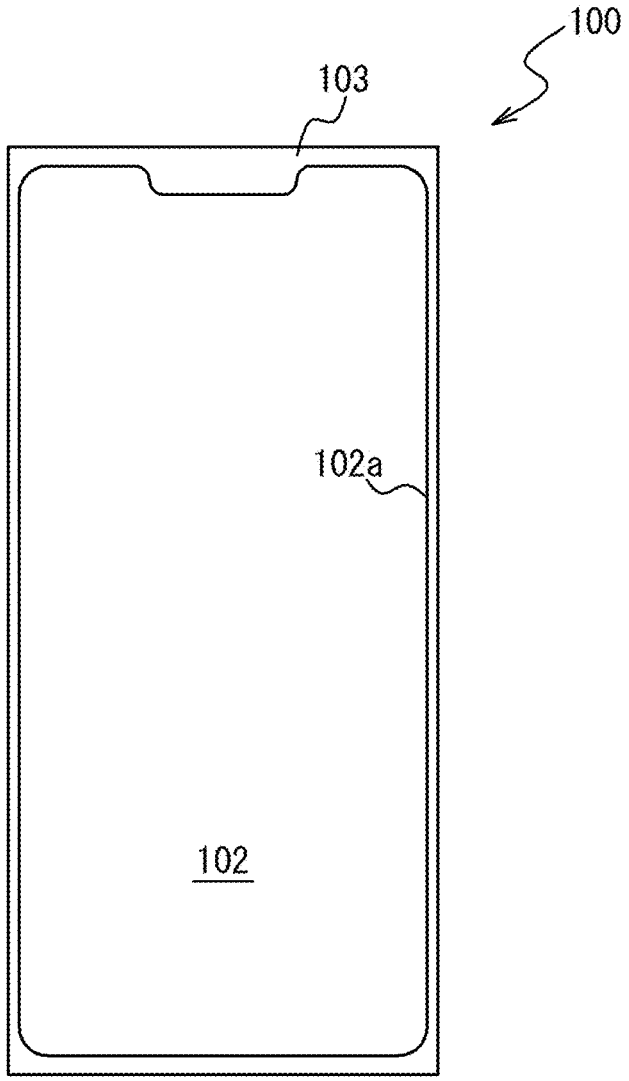
FIG. 1A illustrates an example configuration of a display panel, according to one or more embodiments.

To facilitate understanding, identical reference numerals have been used, where possible, to designate identical elements that are common to the figures. It is contemplated that elements disclosed in one embodiment may be beneficially utilized in other embodiments without specific recitation. Suffixes may be attached to reference numerals for distinguishing identical elements from each other. The drawings referred to herein should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Edge illumination is a technique that notifies the user of calls or other notifications by lighting up the edge of the display. For example, a portable electronic device adapted to edge illumination may be configured to, when receiving emails or other messages, light up the edge of the display to notify the user of the reception. The edge illumination may help the user promptly become aware of notifications especially during standby of the portable electronic device.

The edge illumination feature may be achieved by displaying an edge-illuminated image on a display panel. The edge-illuminated image may include an edge illumination graphic. The edge illumination graphic may be a bright graphic element that extends along at least part of the edge of the display region of a display panel. The display region may be a region in which pixels are disposed to display images.

In one implementation, the edge illumination feature may be achieved by sending an edge-illuminated image from a controller external to the display device. This approach may however increase the communication amount between the display device and the controller, especially when the edge-illuminated image changes over time (e.g., periodically). The increase in the communication amount may cause an undesired increase in the power consumption.

The present disclosure provides various technologies for achieving edge illumination with a reduced communication amount between the display device and the controller. In one or more embodiments, the edge illumination feature can be achieved with a reduced communication amount by sending an edge illumination command, not a full frame edge-illuminated image, from the controller to the display driver. Specifically, in one or more embodiments, a display driver includes first interface circuitry, a graphic memory, image processing circuitry, and drive circuitry. The first interface circuitry is configured to receive the edge illumination command from a controller external to the display driver. The graphic memory is configured to store a first image. The image processing circuitry is configured to generate an edge-illuminated image by overlaying an edge illumination graphic on the first image in response to the edge illumination command. The edge illumination graphic extends along an edge of a display region of a display panel. The drive circuitry is configured to drive the display panel based on the edge-illuminated image. In the following, detailed embodiments of the present disclosure are described.

FIG. 1A illustrates an example configuration of a display panel 100, according to one or more embodiments. In the illustrated embodiment, the display panel 100 includes a display region 102 in which pixels (not illustrated) are disposed and a bezel region 103 in which no pixels are disposed. The display region 102 is used to display an image while the bezel region 103 is not used to display the image. The display region 102 has an edge 102*a* that is a boundary between the display region 102 and the bezel region 103. While FIG. 1A illustrates the display region 102 has rounded-corners and a notch at the top, the shape of the display region 102 may be variously modified. The display region 102 may be simply defined as a rectangle or as a corner-rounded rectangle. The display region 102 can be in any shape other than a rectangle or a corner-rounded rectangle. In some other embodiments, the display panel 100 may be a display panel with an extremely-reduced bezel width (e.g., an edge-to-edge display and an infinity display). Part of the edge 102*a* of the display region 102 may be aligned with the edge of the display panel 100.

In one or more embodiments, edge illumination is achieved by displaying an edge-illuminated image that includes an edge illumination graphic. The edge illumination graphic is a graphic element which extends along at least part of the edge 102*a* of the display region 102 and has increased brightness to at least partially light up the edge 102*a* of the display region 102.

Figure 1B:
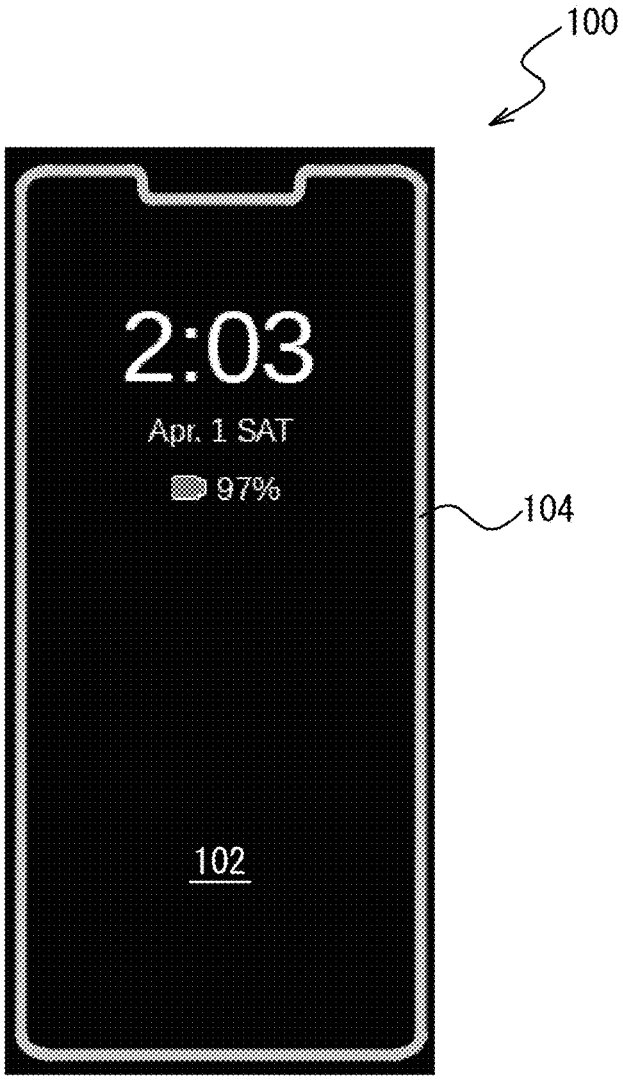
FIGS. 1B, 1C, 1D, and 1E illustrate example edge-illuminated images displayed in a display region of a display panel, according to one or more embodiments.

FIG. 1B is an example edge-illuminated image displayed in the display region 102, according to one or more embodiments. In the illustrated embodiment, the edge-illuminated image includes an edge illumination graphic 104 that extends along the entirety of the edge 102*a* (illustrated in FIG. 1A) of the display region 102.

Figure 1C:
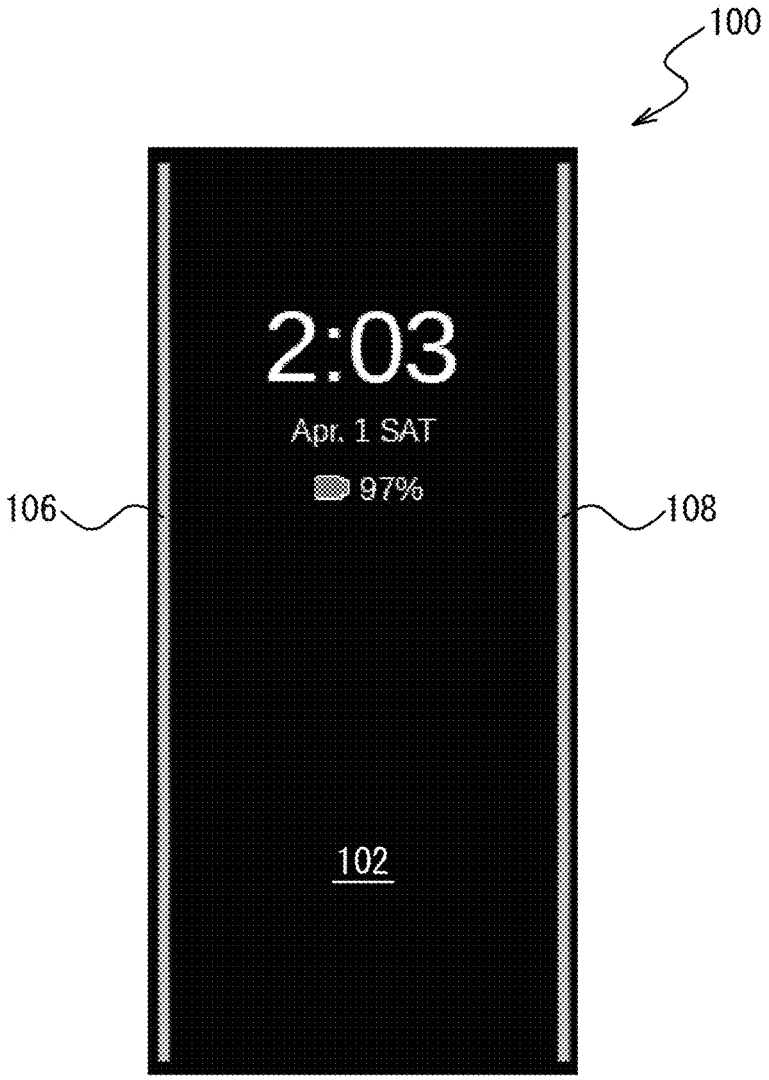

FIG. 1C is another example edge-illuminated image displayed in the display region 102, according to one or more embodiments. An edge illumination graphic may be disposed along part of the edge 102*a* (illustrated in FIG. 1A) of the display region 102. In the illustrated embodiments, the edge-illuminated image includes an edge illumination graphic 106 that extends along a left vertical part of the edge 102*a* of the display region 102 and an edge illumination graphic 108 that extends along a right vertical part of the edge 102*a* of the display region 102.

Figure 1D:
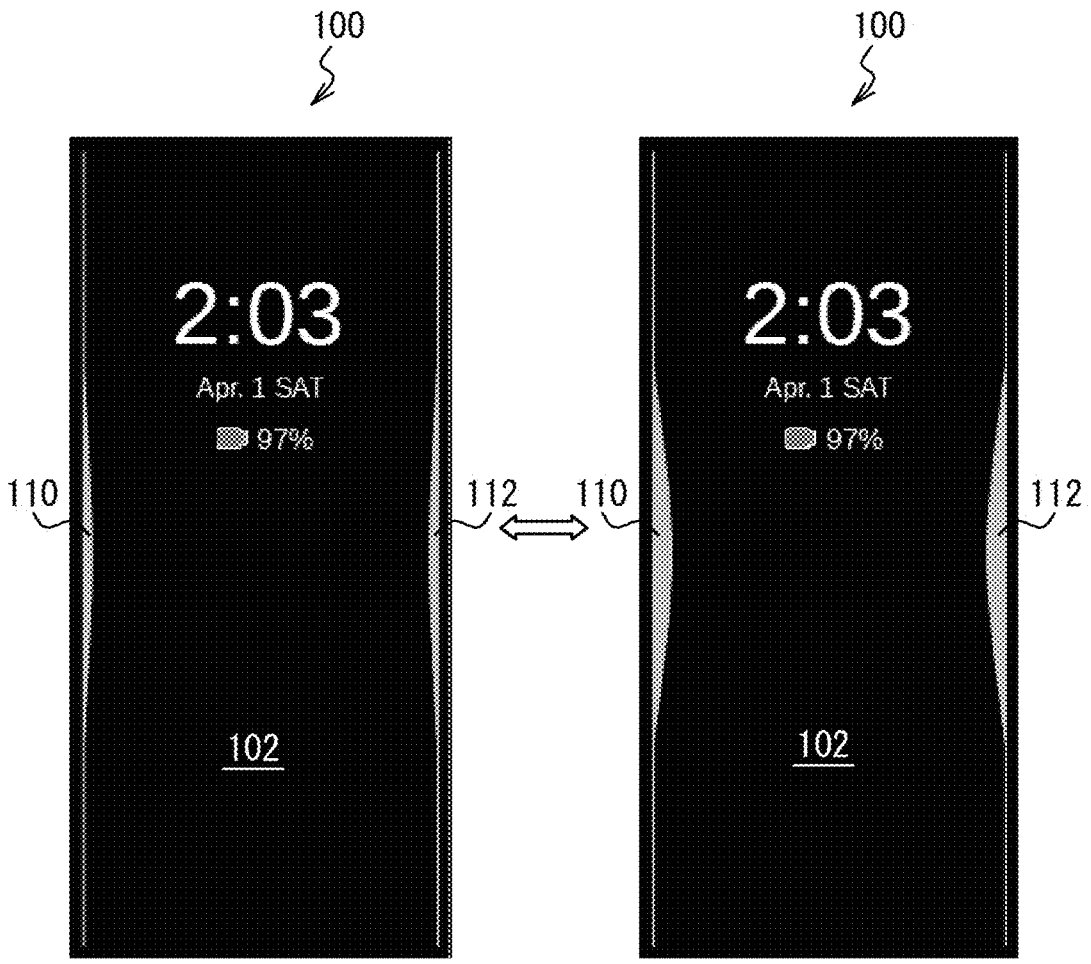

The shape of an edge illumination graphic may change over time. In some embodiments, the shape of an edge illumination graphic may change periodically. FIG. 1D illustrates example changes in edge illumination graphics 110 and 112, according to one or more embodiments. In the illustrated embodiments, the edge illumination graphic 110 extends along the left vertical part of the edge 102*a* of the display region 102 (also see FIG. 1A) and the edge illumination graphic 112 extends along the right vertical part of the edge 102*a*. In one implementation, the widths of the edge illumination graphics 110 and 112 may repeatedly increase and decrease. The left image of FIG. 1D illustrates the edge illumination graphics 110 and 112 with decreased widths, and the right image illustrates the edge illumination graphics 110 and 112 with increased widths.

Figure 1E:
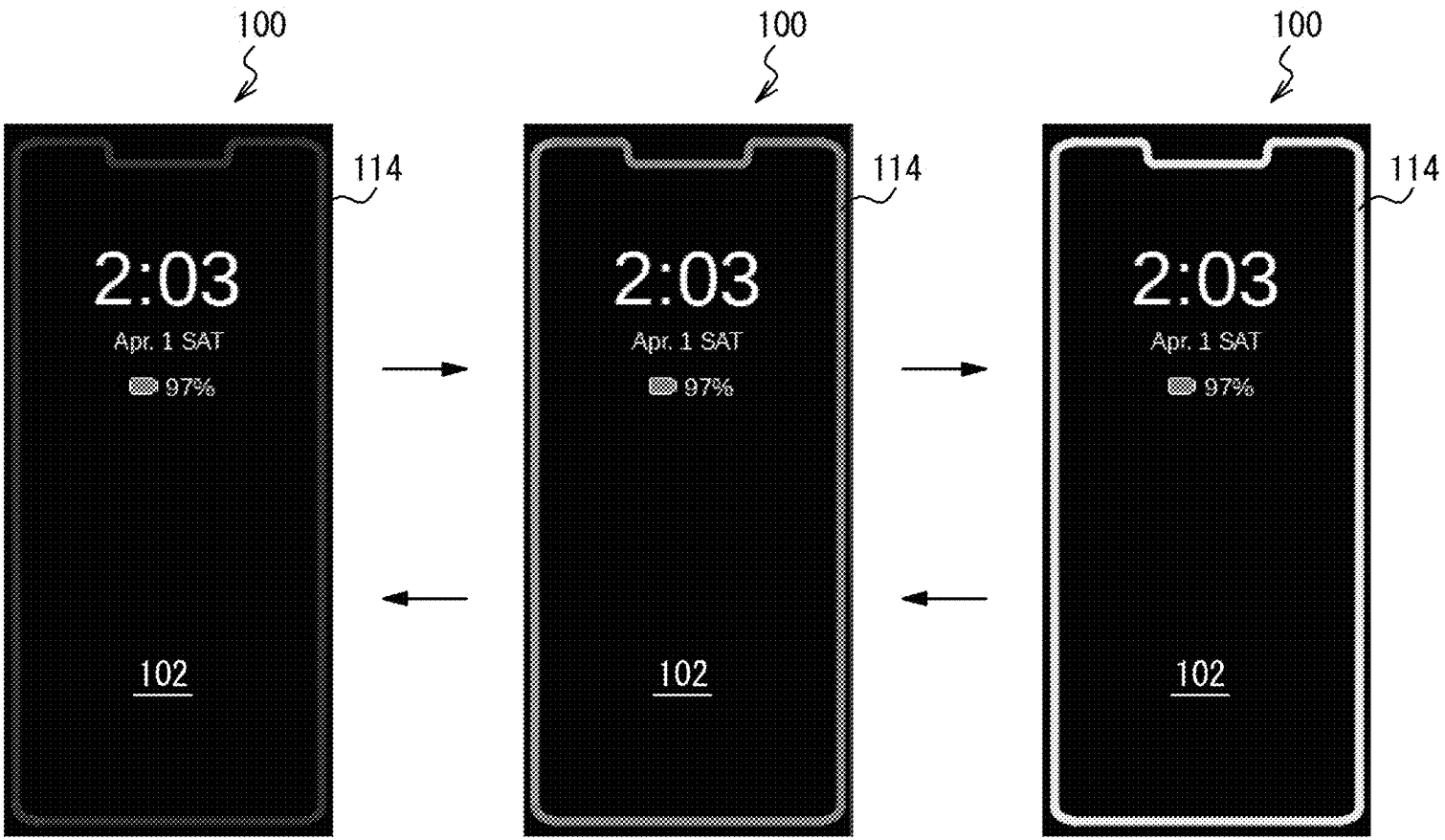

Additionally, or alternatively, the brightness of an edge illumination graphic may change over time. In some embodiments, the brightness of an edge illumination graphic may change periodically. FIG. 1E illustrates example changes in an edge illumination graphic 114, according to one or more embodiments. In the illustrated embodiments, the edge illumination graphic 114 extends along the entirety of the edge 102*a* of the display region 102 (also see FIG. 1A). In one implementation, the brightness of the edge illumination graphic 114 may repeatedly increase and decrease. The left image of FIG. 1E illustrates the edge illumination graphic 114 with decreased brightness, the middle image illustrates the edge illumination graphic 114 with medium brightness, and the right image illustrates the edge illumination graphic 114 with increased brightness.

Figure 2:
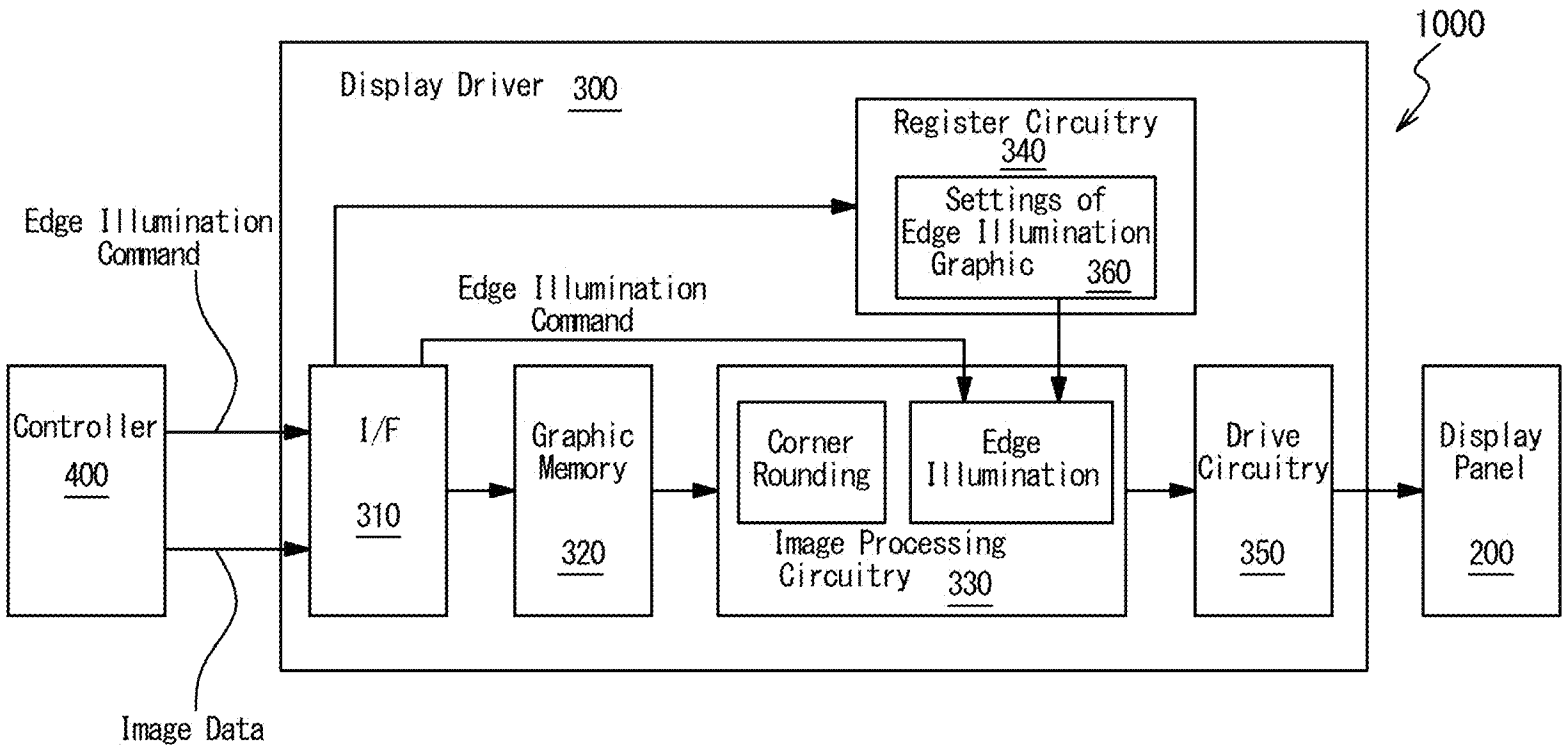
FIG. 2 illustrates an example configuration of a display system adapted to edge illumination, according to one or more embodiments.

FIG. 2 illustrates an example configuration of a display system 1000 adapted to edge illumination, according to one or more embodiments. In the illustrated embodiment, the display system 1000 is configured to display an image on the display panel 200, which may correspond to the display panel 100 described in relation to FIG. 1A. Examples of the display panel 200 includes organic light emitting diodes (OLED) display panel, liquid crystal display (LCD) panels, or other flat display panels.

The display system 1000 includes a display driver 300 and a controller 400 that is external to the display driver 300. The display driver 300 is configured to drive the display panel 200 to display a desired image. The controller 400 is configured to provide image data to the display driver 300.

The image data may correspond to an image to be displayed on the display panel 200, and the display driver 300 may be configured to drive the display panel 200 based on the image data. The image data may include pixel data for respective pixels of the display panel 200. The pixel data may include graylevels of respective subpixels of each pixel.

In one or more embodiments, the controller 400 is further configured to generate and provide an edge illumination command to the display driver 300. The edge illumination command instructs the display driver 300 to display an edge-illuminated image (which may correspond to the edge-illuminated images illustrated in FIGS. 1B to 1E) on the display panel 200. It is to be noted that the edge illumination command excludes pixel data. The display driver 300 may be configured to render an edge-illuminated image in response to reception of the edge illumination command and drive the display panel 200 to display the edge-illuminated image as described later in detail. It is also to be noted that the edge-illuminated image is generated by the display driver 300. The elimination of the need of transferring the edge-illuminated image from the controller 400 to the display driver 300 effectively reduces the communication amount between the display driver 300 and the controller 400.

In the illustrated embodiment, the display driver 300 includes interface (I/F) circuitry 310, a graphic memory 320, image processing circuitry 330, register circuitry 340, and drive circuitry 350. In one implementation, the display driver 300 may be configured as a display driver integrated circuit (DDIC) in which the interface circuitry 310, the graphic memory 320, the image processing circuitry 330, the register circuitry 340, and the drive circuitry 350 are monolithically integrated in a single semiconductor chip.

The interface circuitry 310 is configured to receive the image data from the controller 400 and forward the image data to the graphic memory 320. The interface circuitry 310 is further configured to receive the edge illumination command from the controller 400 and forward the edge illumination command to the image processing circuitry 330. The graphic memory 320 is configured to store the image data received from the interface circuitry 310. The image data stored in the graphic memory 320 may correspond to a full-frame image to be displayed on the display region (which may correspond to the display region 102 illustrated in FIG. 1A) of the display panel 200. In other words, the graphic memory 320 is configured to store and provide a full-frame image to be displayed on the entire display region of the display panel 200.

The image processing circuitry 330 is configured to process the image data received from the graphic memory 320 (i.e., the full-frame image stored in the graphic memory 320) to generate a resulting image to be displayed on the display panel 200. The resulting image (i.e., the processed full-frame image) may be an edge-illuminated image generated in response to the edge illumination command. In one or more embodiments, the processing performed by the image processing circuitry 330 may include a corner rounding process and an edge illumination process. The corner rounding process may process the image data to round the corners of the resulting image displayed on the display panel 200. The edge illumination process may render an edge-illuminated image by overlaying an edge illumination graphic (which may correspond to the edge illumination graphics 104, 106, 108, 110, 112, and 114 illustrated in FIGS. 1B to 1E) on the full-frame image which corresponds to the image data stored in the graphic memory 320. Details of the corner rounding process and the edge illumination process will be described later in detail. The processing performed by the image processing circuitry 330 may further includes other image processes, such as color adjustment, subpixel rendering, scaling, and gamma transformation. The register circuitry 340 is configured to store one or more settings 360 of the edge illumination graphic. The drive circuitry 350 is configured to drive the display panel 200 based on the processed image data received from the image processing circuitry 330.

Figure 3:
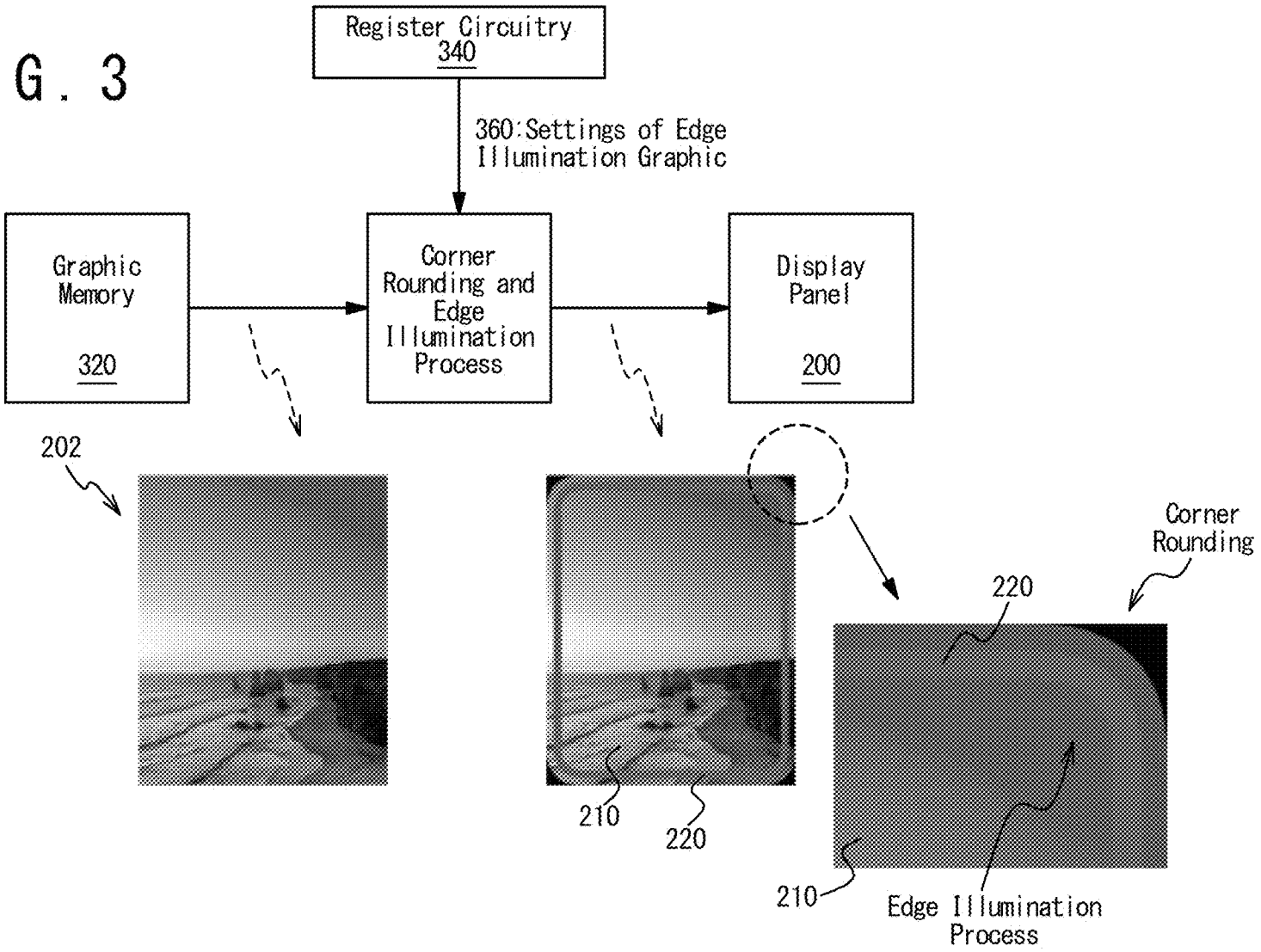
FIG. 3 illustrates an example corner rounding process and edge illumination process, according to one or more embodiments.

FIG. 3 illustrates an example corner rounding process and edge illumination process performed by the image processing circuitry 330, according to one or more embodiments. In FIG. 3, the reference numeral 202 denotes the full-frame image corresponding to the image data stored in the graphic memory 320.

The corner rounding process may process the image data to round the corners of the resulting image displayed on the display panel 200 in line with the shape of the display region 210 of the display panel 200. The display region 210 of the display panel 200 is defined as a corner-rounded rectangle in the embodiment illustrated in FIG. 3. The corner rounding process may include replacing pixel data for pixels outside of the corners with pixel data corresponding to "black". The pixel data corresponding to "black" may include a graylevel of zero. The corner rounding process may further include blurring the corners of the resulting image to improve smoothness of the displayed image at the corners of the display region 210.

The edge illumination process may include rendering an edge illumination graphic 220 and overlaying the edge illumination graphic 220 on the image 202 to render an edge-illuminated image. The rendering of the edge illumination graphic 220 may be based on one or more settings 360 stored in the register circuitry 340. Details of the one or more settings 360 of the edge illumination graphic 220 will be described below in detail. In various embodiments, the image processing circuitry 330 is configured to render the edge-illuminated image in response to the edge illumination command received from the controller 400. In one implementation, the image processing circuitry 330 is configured to render the edge-illuminated image when instructed by the edge illumination command.

In some embodiments, the display system 1000 has a normal operation mode and a standby mode. The normal operation mode may be an operation mode in which image data is transferred from the controller 400 to the display driver 300 to update the display panel 200 in each frame period (or each horizontal synchronization period). The standby mode may be an operation mode in which the no image data is transferred from the controller 400 to the display driver 300. Placing the display system 1000 into the standby mode effectively reduces the power consumption.

Figure 4A:
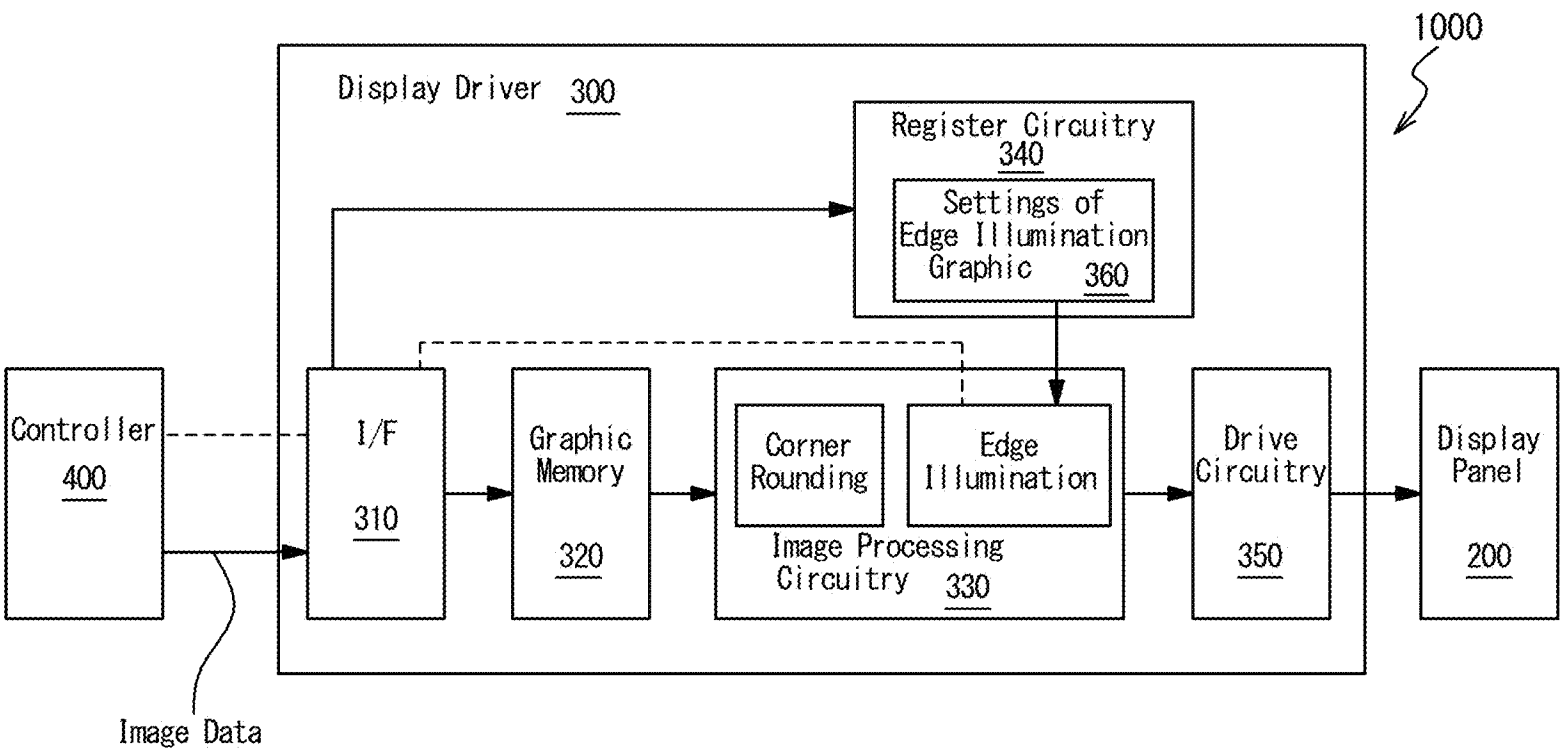
FIG. 4A illustrates an example operation of a display system in a normal operation mode, according to one or more embodiments.

FIG. 4A illustrates an example operation of the display system 1000 in the normal operation mode, according to one or more embodiments. In the normal operation mode, the controller 400 transfers image data to the display driver 300 to update the graphic memory 320 in each frame period, and the display driver 300 updates the image displayed on the display panel 200 based on the update of the graphic memory 320 in each frame period.

Figure 4B:
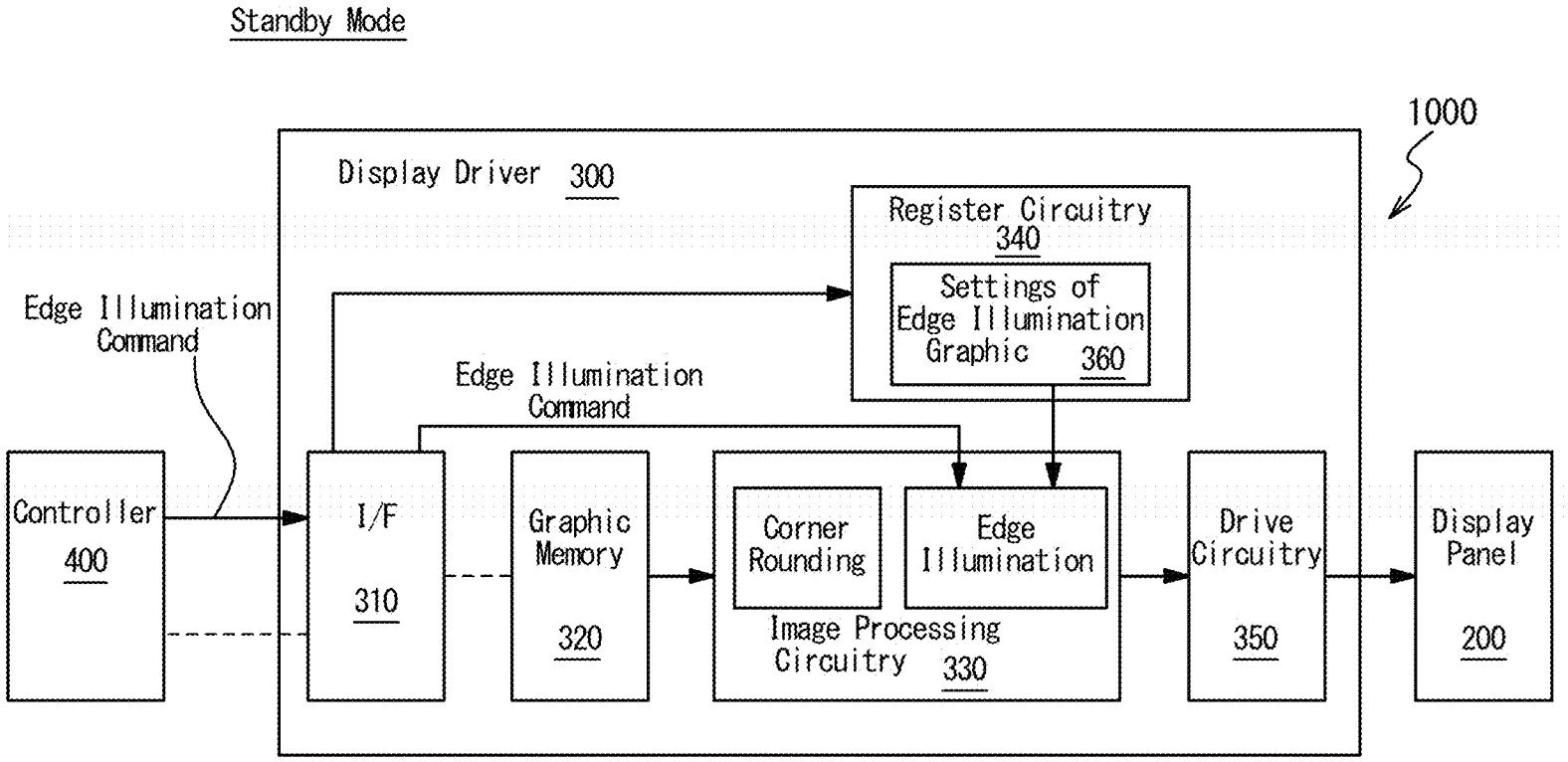
FIG. 4B illustrates an example operation of a display system in a standby mode, according to one or more embodiments.

FIG. 4B illustrates an example operation of the display system 1000 in the standby mode, according to one or more embodiments. In the standby mode, the controller 400 transfers no image data to the display driver 300, and the image data stored in the graphic memory 320 is not updated.

In one or more embodiments, when desiring to display an edge-illuminated image on the display panel 200 (e.g., to notify the user of reception of a call, an email, a message, or the like) in the standby mode, the controller 400 sends an edge illumination command to the display driver 300. It is noted that the edge illumination command includes no pixel data. The image processing circuitry 330 of the display driver 300 renders an edge-illuminated image in response to reception of the edge illumination command.

In one implementation, the rendering of the edge-illuminated image may be achieved as follows. The image processing circuitry 330 retrieves the image data, which corresponds to a full-frame image, from the graphic memory 320. The image processing circuitry 330 may process the image data retrieved from the graphic memory 320 if desired (e.g., applying the corner rounding process to the image data as described in relation to FIG. 3). The image processing circuitry 330 further renders an edge illumination graphic based on the one or more settings 360 stored in the register circuitry 340. The image processing circuitry 330 renders the edge-illuminated image by overlying the edge illumination graphic on the full-frame image. The drive circuitry 350 drives the display panel 200 based on the edge-illuminated image. The drive circuitry 350 may drive the display panel 200 to display the edge-illuminated image. In embodiments where the image processing circuitry 330 further processes the edge-illuminated image, the drive circuitry 350 may drive the display panel 200 to display the processed edge-illuminated image.

In various embodiments, the rendering of the edge illumination graphic may be controlled based on the one or more settings 360 stored in the register circuitry 340. The one or more settings 360 may be selected from the group consisting of: the shape of the edge illumination graphic; the brightness of the edge illumination graphic; the color of the edge illumination graphic; how the shape of the edge illumination graphic is to be changed; how the brightness of the edge illumination graphic is to be changed; how the color of the edge illumination graphic is to be changed; the periodicity of the change in the shape of the edge illumination graphic; the periodicity of the change in the brightness of the edge illumination graphic; and the periodicity of the change in the color of the edge illumination graphic.

In one or more embodiments, the one or more settings 360 stored in the register circuitry 340 includes how the brightness of the edge illumination graphic is to be changed, and the image processing circuitry 330 is configured to change the brightness of the edge illumination graphic over time based on the one or more settings 360.

Figure 5:
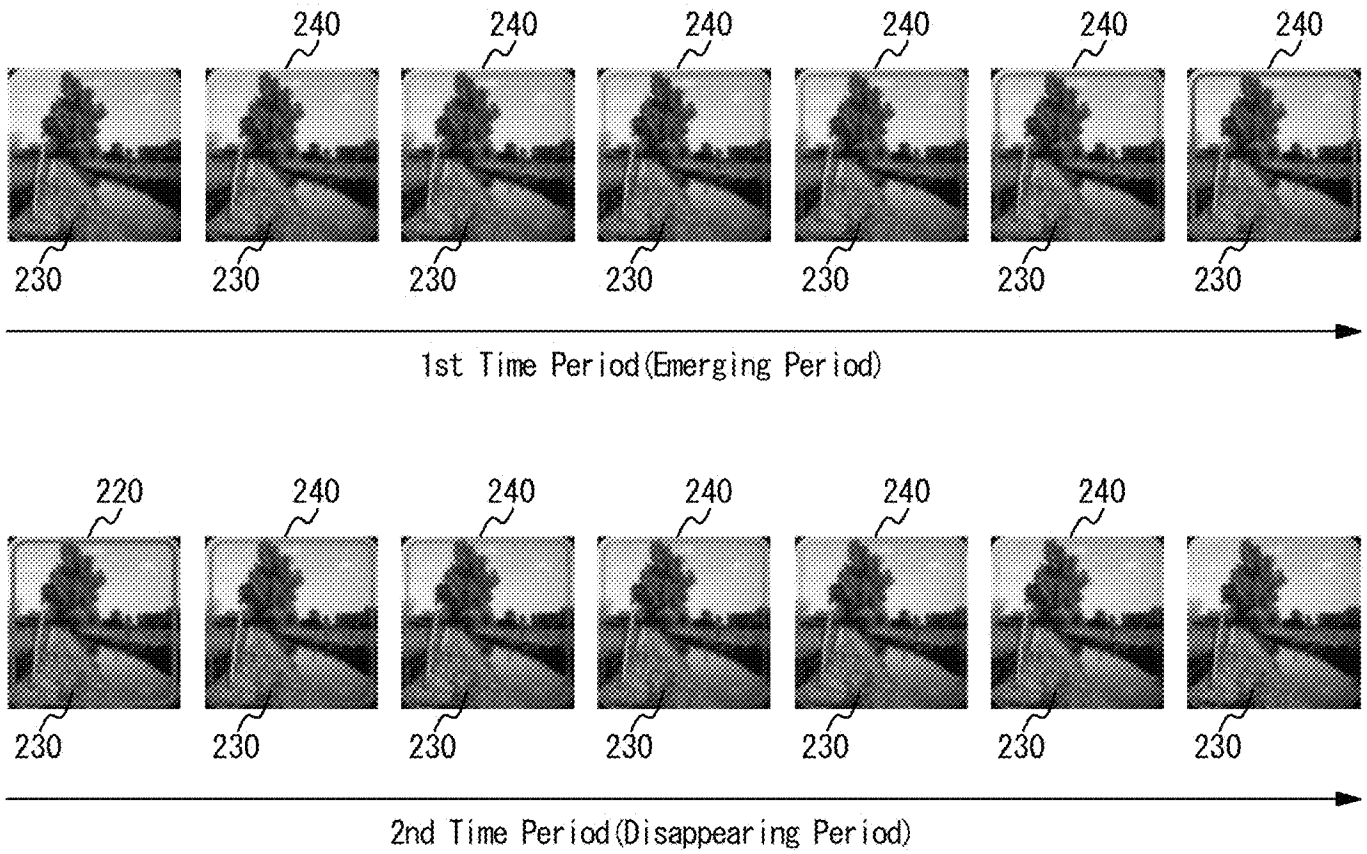
FIG. 5 illustrates example changes in the brightness of an edge illumination graphic, according to one or more embodiments.

FIG. 5 illustrates example changes in the brightness of an edge illumination graphic, denoted by the reference numeral 240, according to one or more embodiments. In illustrated embodiment, the edge illumination graphic 240 is overlayed on an image 230 that corresponds to image data stored in the graphic memory 320. In some embodiments, the image processing circuitry 330 may be configured to render the edge illumination graphic 240 such that the brightness of the edge illumination graphic 240 gradually increases during a first time period (or an emerging period). In such embodiments, the one or more settings 360 stored in the register circuitry 340 may include the first time period. The image processing circuitry 330 may be further configured to render the edge illumination graphic 240 such that the brightness of the edge illumination graphic 240 gradually decreases during a second time period (or a disappearing period) that follows the first time period. In such embodiments, the one or more settings 360 stored in the register circuitry 340 may further include the second time period.

Figure 6:
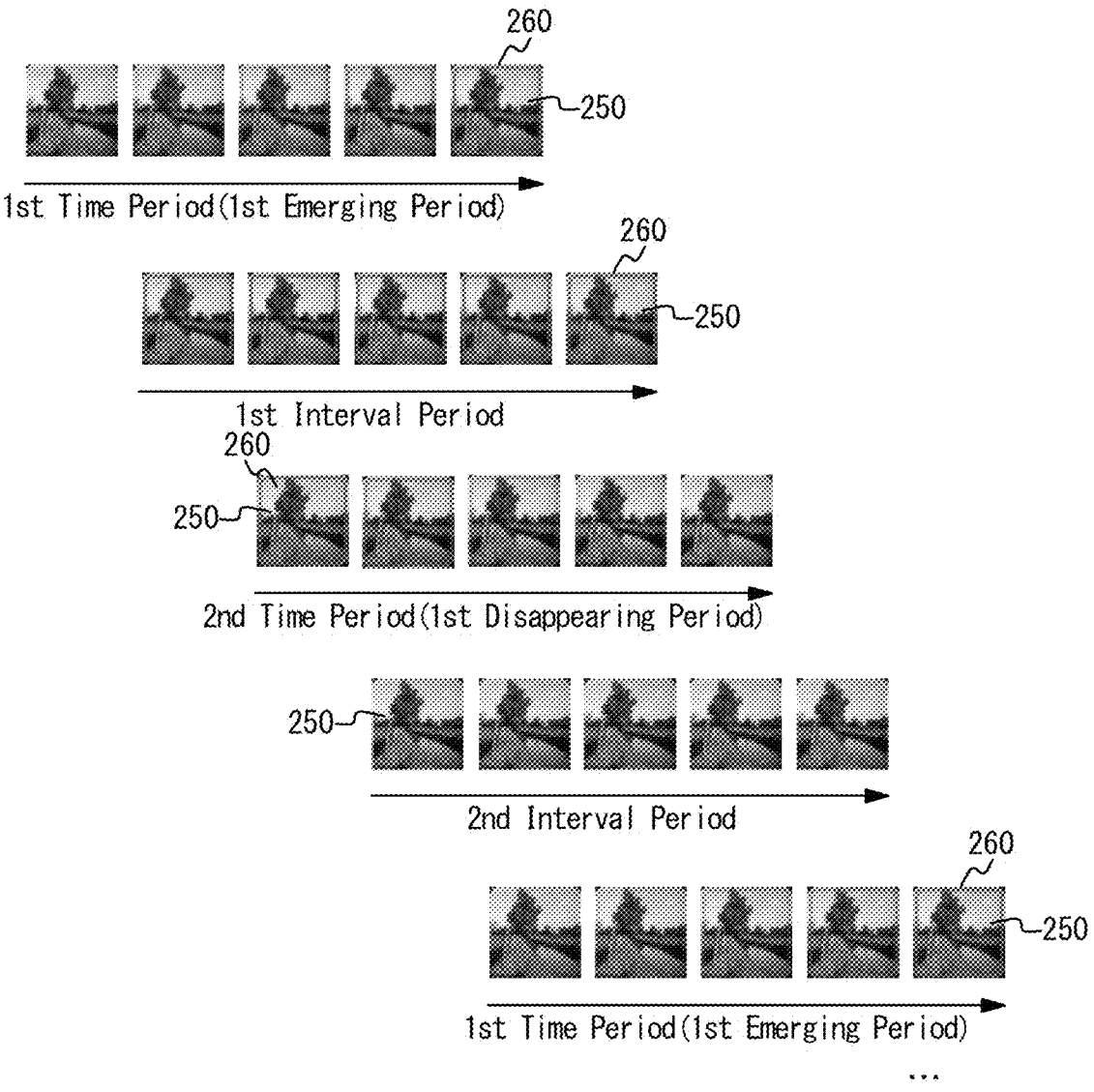
FIG. 6 illustrates example changes in the brightness of an edge illumination graphic, according to other embodiments.

FIG. 6 illustrates other example changes in the brightness of an edge illumination graphic, denoted by the reference numeral 260, according to other embodiments. In illustrated embodiment, the edge illumination graphic 260 is overlayed on an image 250, which corresponds to image data stored in the graphic memory 320. In some embodiments, the image processing circuitry 330 may be configured to render the edge illumination graphic 260 such that the brightness of the edge illumination graphic 260 gradually increases during a first time period (or a first emerging period). In such embodiments, the one or more settings 360 stored in the register circuitry 340 may include the first time period.

The image processing circuitry 330 may be further configured to render the edge illumination graphic 260 such that the brightness of the edge illumination graphic 260 is kept constant during a first interval period that follows the first time period. In such embodiments, the one or more settings 360 stored in the register circuitry 340 may further include the first interval period.

The image processing circuitry 330 may be further configured to render the edge illumination graphic 260 such that the brightness of the edge illumination graphic 260 gradually decreases during a second time period (or a first disappearing period) that follows the first interval period. In such embodiments, the one or more settings 360 stored in the register circuitry 340 may further include the second time period.

The image processing circuitry 330 may be further configured to render the edge illumination graphic 260 such that the brightness of the edge illumination graphic 260 is kept constant during a second interval period that follows the second time period. In such embodiments, the one or more settings 360 stored in the register circuitry 340 may further include the second interval period.

The image processing circuitry 330 may be further configured to render the edge illumination graphic 260 to repeat the above-described procedure that includes the first time period, the first interval period, the second time period, and the second interval period.

In one or more embodiments, the one or more settings 360 stored in the register circuitry 340 includes how the shape of the edge illumination graphic is to be changed, and the image processing circuitry 330 is configured to change the shape of the edge illumination graphic over time based on the one or more settings 360.

Figure 7:
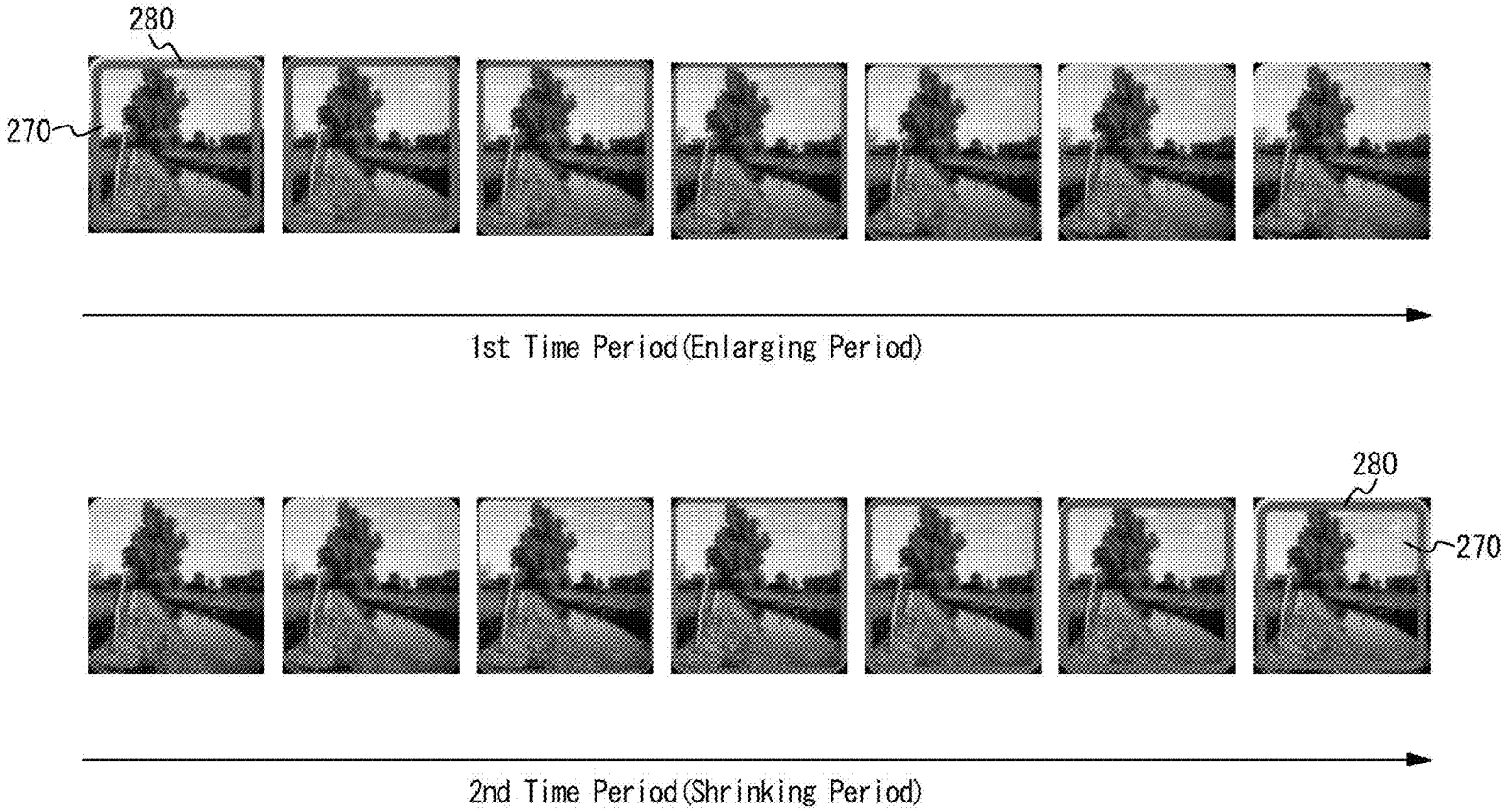
FIG. 7 illustrates example changes in the shape of an edge illumination graphic, according to other embodiments.

FIG. 7 illustrates example changes in the shape of an edge illumination graphic, denoted by the reference numeral 280, according to other embodiments. In illustrated embodiment, the edge illumination graphic 280 is overlayed on an image 270 that corresponds to image data stored in the graphic memory 320. In some embodiments, the image processing circuitry 330 may be configured to render the edge illumination graphic 280 such that the shape of the edge illumination graphic 280 gradually changes, and the one or more settings 360 stored in the register circuitry 340 may include how the shape of the edge illumination graphic 280 is to be changed.

The image processing circuitry 330 may be configured to successively scale the edge illumination graphic 280 to enlarge the edge illumination graphic 280 over a first time period (or an enlarging period). In such embodiments, the one or more settings 360 stored in the register circuitry 340 may include the first time period. In some embodiments, the one or more settings 360 stored in the register circuitry 340 may further include a target size of the edge illumination graphic 280, and the image processing circuitry 330 may be configured to gradually enlarge the edge illumination graphic 280 to the target size during the first time period. It is noted that the image processing circuitry 330 may be configured to enlarge the edge illumination graphic 280 beyond the display region of the display panel 200. In the embodiment illustrated in FIG. 7, the edge illumination graphic 280 partially goes out beyond the display region of the display panel 200 in a latter part of the first time period.

The image processing circuitry 330 may be further configured to successively scale the edge illumination graphic 280 to shrink the edge illumination graphic 280 over a second time period (or a shrinking period) that follows the first time period. In such embodiments, the one or more settings 360 stored in the register circuitry 340 may include the second time period.

Figure 8:
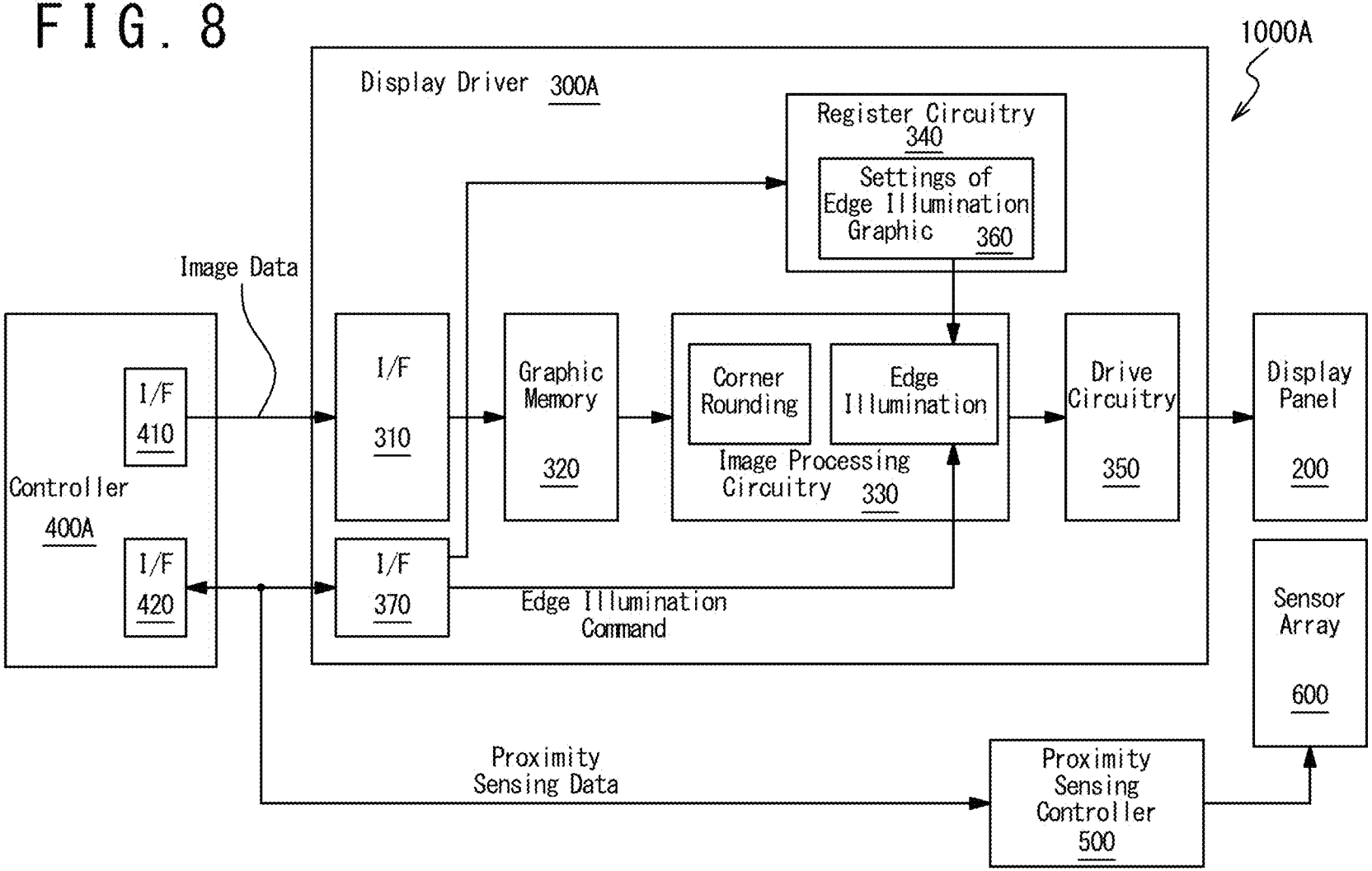
FIG. 8 illustrates an example configuration of a display system, according to other embodiments.

FIG. 8 illustrates an example configuration of the display system, denoted by the reference numeral 1000A, according to other embodiments. In the illustrated embodiment, the display system 1000A includes a display driver 300A and a controller 400A coupled to the display driver 300A.

The display system 1000A is configured to transfer image data and an edge illumination command from the controller 400A to the display driver 300A via separate communication links. In one implementation, the controller 400A includes first interface circuitry 410 and second interface circuitry 420 while the display driver 300A includes first interface circuitry 310 (which may correspond to the interface circuitry 310 illustrated in FIG. 2) and second interface circuitry 370. The first interface circuitry 410 of the controller 400A is communicably coupled to the first interface circuitry 310 of the display driver 300A, and the second interface circuitry 420 of the controller 400A is communicably coupled to the second interface circuitry 370 of the display driver 300A. The first interface circuitry 410 of the controller 400A is configured to transfer the image data to the first interface circuitry 310 of the display driver 300A, and the first interface circuitry 310 is configured to forward the image data to the graphic memory 320. The second interface circuitry 420 of the controller 400A is configured to transfer the edge illumination command to the second interface circuitry 370 of the display driver 300A, and the second interface circuitry 370 is configured to forward the edge illumination command to the image processing circuitry 330.

In various embodiments, the first interface circuitry 410 of the controller 400A and the first interface circuitry 310 of the display driver 300A are configured to communicate with each other in accordance with a first communication protocol, and the second interface circuitry 420 of the controller 400A and the second interface circuitry 370 of the display driver 300A are configured to communicate with each other in accordance with a second communication protocol different from the first communication protocol. The data transfer rate of the communications between the first interface circuitry 410 and the first interface circuitry 310 may be higher than the data transfer rate of the communications between the second interface circuitry 420 and the second interface circuitry 370. In one implementation, the first interface circuitry 410 and the first interface circuitry 310 may be configured to communicate with each other in accordance with the Mobile Industry Processor Interface (MIPI) standard, and the second interface circuitry 420 and the second interface circuitry 370 may be configured to communicate with each other in accordance with the inter-integrated circuit (I2C) standard.

In some embodiments, the display system 1000A may be adapted to proximity sensing. The display system 1000A may include a proximity sensing controller 500 and a sensor array 600 that may be at least partially overlap the display panel 200. The proximity sensing controller 500 may be configured to detect an input object that is in contact to or nearly in contact with the sensor array 600. The detection of the input object may be based on capacitive proximity sensing (e.g., absolute capacitance sensing (or self-capacitance sensing) and transcapacitance sensing (or mutual capacitance sensing)). In such embodiments, the sensor array 600 may include sensor electrodes and the proximity sensing controller 500 may be configured to detect the input object based on resulting signals received from the sensor electrodes.

In embodiments where the display system 1000A is adapted to proximity sensing using the proximity sensing controller 500 and the sensor array 600, the second interface circuitry 420 of the controller 400A may be also used to provide communications between the controller 400A and the proximity sensing controller 500. The proximity sensing controller 500 may be configured to generate proximity sensing data that includes positional information of the detected input object. The "positional information" as used herein broadly encompasses absolute position, relative position, velocity, acceleration, and other types of spatial information. The second interface circuitry 420 of the controller 400A may be configured to receive the proximity sensing data from the proximity sensing controller 500. In one implementation, the second interface circuitry 420 of the controller 400A may be configured to transfer the edge illumination command during a period during which the proximity sensing is not performed. The use of the second interface circuitry 420 of the controller 400A for both the edge illumination function and the proximity sensing function may effectively reduce hardware of the controller 400A.

Figure 9:
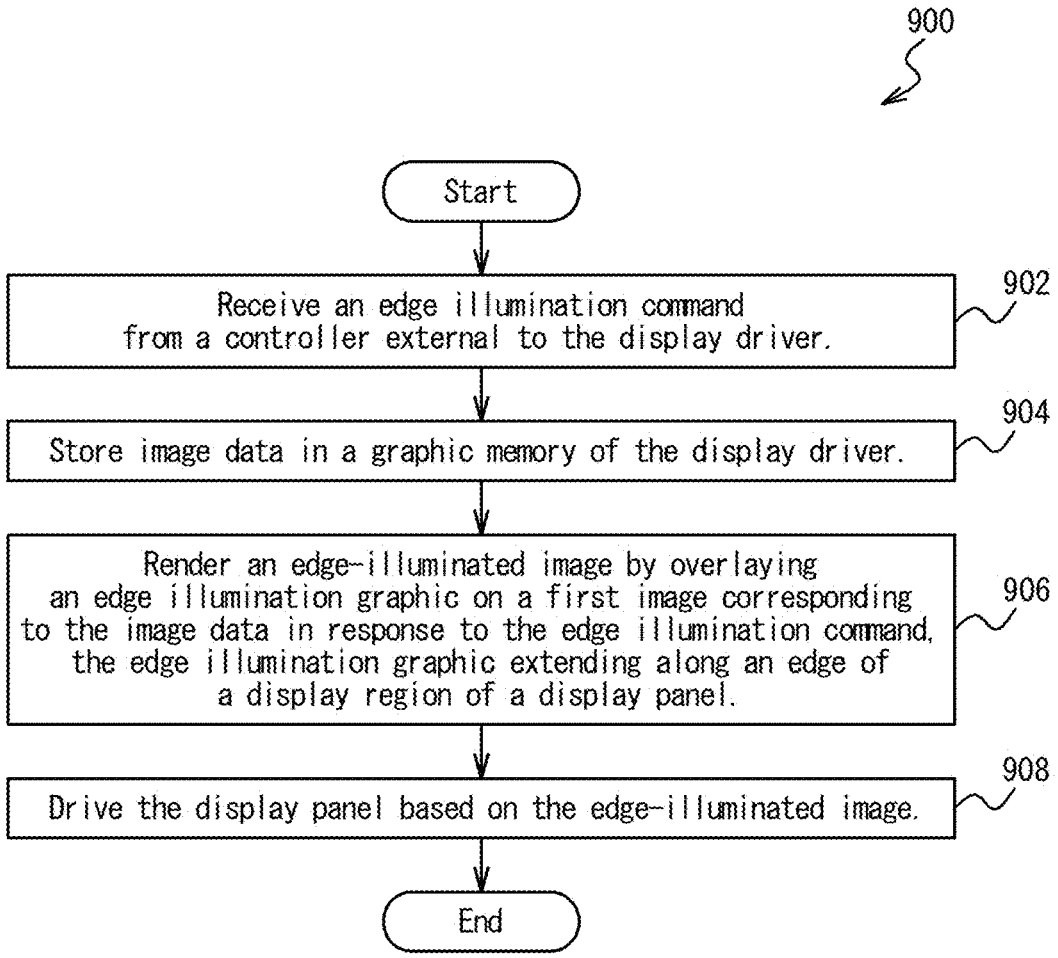
FIG. 9 illustrates an example method of operating a display driver, according to one or more embodiments.

Method 900 of FIG. 9 illustrates example steps for operating a display driver (e.g., the display drivers 300 and 300A illustrated in FIG. 2 and FIG. 8), according to one or more embodiments. It is noted that one or more of the steps illustrated in FIG. 9 may be repeated and/or performed in a different order than the order illustrated in FIG. 9. It is further noted that two or more steps may be implemented at the same time.

The method 900 includes receiving an edge illumination command from a controller external to the display driver at step 902. The method 900 further includes storing image data in a graphic memory (e.g., the graphic memory 320) of the display driver at step 904. The method 900 further includes rendering an edge-illuminated image (e.g., illustrated in FIGS. 1B-1E, 3, 5 to 7) by overlaying an edge illumination graphic (e.g., the edge illumination graphics 104, 106, 108, 110, 112, and 114 illustrated in FIGS. 1B-1E, and the edge illumination graphics 220, 240, 260, and 280 illustrated in FIGS. 3, 5-7) on a first image corresponding to the image data in response to the edge illumination command. The edge illumination graphic extends along an edge of a display region (e.g., the display region 102 illustrated in FIG. 1A) of a display panel (e.g., the display panel 100 illustrated in FIG. 1A and the display panel 200 illustrated in FIGS. 2 and 8) at step 906. The method 900 further includes driving the display panel based on the edge-illuminated image at step 908.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display driver, comprising:

first interface circuitry configured to receive an edge illumination command from a controller external to the display driver;

a graphic memory configured to store image data;

image processing circuitry configured to render an edge-illuminated image by overlaying an edge illumination graphic on a first image corresponding to the image data in response to the edge illumination command, the edge illumination graphic extending along an edge of a display region of a display panel;

register circuitry configured to store one or more settings of the edge illumination graphic, wherein the image processing circuitry is further configured to render the edge illumination graphic based on the stored one or more settings of the edge illumination graphic; and drive circuitry configured to drive the display panel based on the edge-illuminated image.

2. The display driver of claim 1, wherein the one or more settings of the edge illumination graphic are selected from the group consisting of:

a shape of the edge illumination graphic;

brightness of the edge illumination graphic;

a color of the edge illumination graphic;

how the shape of the edge illumination graphic is to be changed;

how brightness of the edge illumination graphic is to be changed;

how the color of the edge illumination graphic is to be changed;

a periodicity of a change in the shape of the edge illumination graphic;

a periodicity of a change in the brightness of the edge illumination graphic; and a periodicity of a change in the color of the edge illumination graphic.

3. The display driver of claim 1, wherein the one or more settings comprises how brightness of the edge illumination graphic is to be changed and a first time period, and wherein the overlaying the edge illumination graphic comprises gradually increasing the brightness of the edge illumination graphic over the first time period.

4. The display driver of claim 3, wherein the one or more settings of the edge illumination graphic further comprises a second time period that follows the first time period; and wherein the overlaying the edge illumination graphic further comprises gradually decreasing the brightness of the edge illumination graphic over the second time period.

5. The display driver of claim 1, wherein the one or more settings comprises how a shape of the edge illumination graphic is to be changed and a first time period, and wherein the overlaying the edge illumination graphic comprises successively scaling the edge illumination graphic to enlarge the edge illumination graphic over the first time period.

6. The display driver of claim 5, wherein the one or more settings of the edge illumination graphic further comprises a target size, and wherein the successively scaling the edge illumination graphic comprises enlarging the edge illumination graphic to the target size.

7. The display driver of claim 5, wherein the one or more settings of the edge illumination graphic further comprises a second time period that follows the first time period, and wherein the overlaying the edge illumination graphic further comprises successively scaling the edge illumination graphic to shrink the edge illumination graphic over the second time period.

8. The display driver of claim 1, wherein the overlaying the edge illumination graphic comprises adjusting the edge illumination graphic over time according to a stored setting in the display driver.

9. The display driver of claim 1, further comprising second interface circuitry disposed separately from the first interface circuitry and configured to receive the image data from the controller.

10. A display system, comprising:

a controller configured to generate an edge illumination command;

a display panel comprising a display region; and a display driver comprising:

first interface circuitry configured to receive the edge illumination command from the controller, a graphic memory configured to store image data, image processing circuitry configured to render an edge-illuminated image by overlaying an edge illumination graphic on a first image corresponding to the image data in response to the edge illumination command, the edge illumination graphic extending along an edge of the display region of the display panel, register circuitry configured to store one or more settings of the edge illumination graphic, wherein the image processing circuitry is further configured to render the edge illumination graphic based on the stored one or more settings of the edge illumination graphic, and drive circuitry configured to drive the display panel based on the edge-illuminated image.

11. The display system of claim 10, wherein the one or more settings of the edge illumination graphic are selected from the group consisting of:

a shape of the edge illumination graphic;

brightness of the edge illumination graphic;

a color of the edge illumination graphic;

how the shape of the edge illumination graphic is to be changed;

how the brightness of the edge illumination graphic is to be changed;

how the color of the edge illumination graphic is to be changed;

a periodicity of a change in the shape of the edge illumination graphic;

a periodicity of a change in the brightness of the edge illumination graphic; and a periodicity of a change in the color of the edge illumination graphic.

12. The display system of claim 10, wherein the controller is further configured to:

update the first image stored in the graphic memory in a normal operation mode of the display system; and not update the first image stored in the graphic memory in a standby mode of the display system.

13. The display system of claim 10, wherein the display driver further comprises second interface circuitry disposed separately from the first interface circuitry and configured to receive the first image from the controller.

14. The display system of claim 10, further comprising a proximity sensing controller, wherein the controller comprises third interface circuitry configured to:

transmit the edge illumination command to the first interface circuitry; and communicate with the proximity sensing controller.

15. A method of operating a display driver, comprising:

receiving an edge illumination command from a controller external to the display driver;

storing image data in a graphic memory of the display driver;

storing one or more settings of an edge illumination graphic in register circuitry of the display driver;

rendering, based on the stored one or more settings of the edge illumination graphic, an edge-illuminated image by overlaying the edge illumination graphic on a first image corresponding to the image data in response to the edge illumination command, the edge illumination graphic extending along an edge of a display region of a display panel; and driving the display panel based on the edge-illuminated image.

16. The method of claim 15, wherein the one or more settings of the edge illumination graphic are selected from the group consisting of:

a shape of the edge illumination graphic;

brightness of the edge illumination graphic;

a color of the edge illumination graphic;

how the shape of the edge illumination graphic is to be changed;

how the brightness of the edge illumination graphic is to be changed;

how the color of the edge illumination graphic is to be changed;

a periodicity of a change in the shape of the edge illumination graphic;

a periodicity of a change in the brightness of the edge illumination graphic; and a periodicity of a change in the color of the edge illumination graphic.

17. The method of claim 15, wherein the overlaying the edge illumination graphic comprises adjusting the edge illumination graphic over time according to the stored one or more settings stored setting in the display driver.

* * * * *